US005426486A

United States Patent [19]

Miskinis et al.

[11] Patent Number: 5,426,486

[45] Date of Patent: Jun. 20, 1995

[54] TONER MONITOR HAVING MAGNETIC FIELD CONTROL

[75] Inventors: Edward T. Miskinis, Rochester; Richard A. Weitzel, Hilton; James C. Maher, North Rose, all of N.Y.

[73] Assignee: Eastman Kodak Company, Rochester, N.Y.

[21] Appl. No.: 199,903

[22] Filed: Feb. 22, 1994

[51] Int. Cl.[6] ..... G03G 21/00

[52] U.S. Cl. ..... 355/208; 118/689; 118/690; 355/204; 355/246

[58] Field of Search ..... 118/689, 690, 688; 355/246, 208, 203, 204; 222/DIG. 1

[56] References Cited

U.S. PATENT DOCUMENTS

| | | | |
|---|---|---|---|
| 3,727,065 | 4/1973 | Maksymiak | 250/218 |
| 3,892,672 | 7/1975 | Gawron | 252/62.1 |
| 4,243,059 | 1/1981 | Hammon et al. | 118/689 X |
| 4,266,141 | 5/1981 | Hirakura et al. | 250/564 |
| 4,342,283 | 8/1982 | Terashima | 118/689 |
| 4,405,226 | 9/1983 | Kimura et al. | 118/689 X |
| 4,452,174 | 6/1984 | Fedder | 118/689 |
| 4,515,292 | 5/1985 | Koos, Jr. | 118/689 X |
| 4,582,415 | 4/1986 | Hyodo et al. | 118/691 X |
| 4,804,996 | 2/1989 | Snelling | 355/3 |
| 4,956,669 | 9/1990 | Nakamura | 355/246 X |
| 5,111,247 | 5/1992 | Nichols | 355/246 |
| 5,117,259 | 5/1992 | Etou et al. | 355/203 |
| 5,189,475 | 2/1993 | Fournia et al. | 355/246 |

*Primary Examiner*—Matthew S. Smith
*Attorney, Agent, or Firm*—Dennis R. Arndt

[57] ABSTRACT

A toner monitor which measures the magnetic permeability of the developer mix uses a coil around the toner monitor so that when energized with a DC current, the coil acts as an electromagnet to align the developer mix in a consistent fashion at the monitor. The permeability of the mix is measured and the DC current to the coil is inhibited allows the measured sample to fall away or be moved away from the sensor by mixing augers or paddles. When current to the coil is once again restored, another sample is captured and aligned with the monitor. Information concerning the permeability of the developer mix is used to control replenishment of the toner.

6 Claims, 3 Drawing Sheets

TONER MONITOR HAVING MAGNETIC FIELD CONTROL

FIELD OF THE INVENTION

The present invention relates broadly to electrostatographic apparatus utilizing a multi-component developer and more particularly, to means for automatically controlling the concentration of the components of the developer during operation of the apparatus.

BACKGROUND OF THE INVENTION

In an electrostatographic apparatus, an electrostatic image is formed on a dielectric material through photoconduction, electrostatic discharge or the like. A powder or liquid developer is applied to the material and adheres to the areas of high electrostatic charge to form a toner image. A toner image is transferred and fixed to a copy sheet to provide a permanent reproduction. Alternatively, the toner image may be fixed to the material on which the electrostatic image is originally formed. A powdered developer generally comprises two components which are mixed together. The image is actually developed by toner particles of small size which are colored black or another suitable color. Magnetic or non-magnetic carrier particles arc mixed with the toner particles to aid in application of the toner particles to the material carrying the electrostatic image.

The carrier particles are generally larger in size than the toner particles and exhibit different tribo-electric characteristics from the toner particles. Agitation of the developer causes the carrier particles and toner particles to rub together and produce opposite electrostatic charges which cause the toner particles to adhere to the carrier particles and also to the electrostatic image on the material for development. The carrier particles are not consumed in the development process, as are the toner particles, but are recovered and recycled.

The carrier particles which are recovered are mixed with the developer and used again in the developing process. However, since toner was consumed, the ratio of toner to carrier particles progressively decreases. For this reason, it is necessary to periodically add additional toner to maintain the toner to carrier ratio at the desired value. If this ratio chops significantly, the density of the developed image will drop by a corresponding amount. The ratio of toner to carrier particles in the developer is known in the art as the toner density.

However, factors other than toner density act to vary the developed image density. The amount of induced electrostatic charge in the developer, the shapes of the toner and carrier particles, the degree of adherence of the toner particles to the carrier particles, the amount of deteriorated carrier particles, the ambient temperature and humidity all act as variables to effect the image density.

The developing ability of the developer for electrostatography is thus the sum total of all variables including those enumerated above and may be defined as the amount of toner which adheres to the electrostatically charged surface of unit area and the unit of electrostatic charge. Due to deterioration of carrier particles, for example, the developing ability and thereby the image density may decrease even though the toner density remains constant or even increases.

Monitoring toner concentration in a two-component development system is a complex task, usually requiring measurement of representative samples of the developer mix over a period of time. The samples are best measured as the developer station is executing its primary role of developing the latent image, but the measuring technique should not interfere with the developer station's primary role. Optical monitors have been used to measure developer reflection as a function of toner concentration as shown in U.S. Pat. Nos. 4,956,668 and 4,266,141. These monitors work fine when there is a significant reflectance difference between the carrier and toner surface. When the carrier and toner have similar reflectance properties, another measure has to be used. With the small particle development (SPD) process, this situation exists. The toner and carrier are similar in reflectance. Magnetic permeability has been selected as the property to monitor. There is a direct correlation between magnetic permeability and the toner concentration.

Using magnetic permeability, sampling technique is crucial. The alignment and packing of the magnetic carrier particles effects the magnetic permeability along with toner concentration. A common location for a magnetic permeability toner monitor is at the bottom of the station sump. The developer is held near the monitor detecting zone by gravity and paddles in the sump transport the mix. This sampling technique is very much affected by the packing of the developer caused by gravity and the motion of the paddles. Spacing between the paddles and the monitors is another critical factor in sampling. Too tight of a spacing jams the mix against the monitor and too loose of a spacing does not transport the mix past the monitor. If the monitor is relocated up onto the side wall of the station sump, developer mix continuously flows by the monitor; however, air entrapment in the mix will give a false toner concentration reading.

A better situation would be a sampling technique that is not restrained by the sump configuration and the material is presented to the detecting monitor in a manner that toner concentration alone is affecting permeability. To be able to sample developer directly in the sump and not have to transport the mix to a sampling chamber would be a substantial benefit. To be able to consistently sample developer mixes possessing residual magnetism would also be a desired feature.

SUMMARY OF THE INVENTION

An apparatus embodying the present invention uses a coil around a toner monitor which measures the magnetic permeability of the developer mix. The coil is activated by a DC current at prescribed intervals to align the developer mix in a consistent fashion over the detecting zone. The permeability of the mix is measured and the DC current to the coil is inhibited which allows the measured sample to be moved away from the sensor by the mixing auger or paddles. When current to the coil is once again restored, another sample is captured and aligned. The maximum sampling frequency would be dependent on the developer flow. Too high sampling frequency may result in a recapture and measurement of the same developer sample. On the other hand, too low a sample frequency would not be representative of the developer mix and improper replenishment may occur.

The present invention provides an electrostatographic machine comprising a supply sump for mixing and supplying toner developer to the machine during operation and a toner monitor mounted adjacent to the supply sump for measuring the magnetic permeability of the toner developer in the sump. The machine also includes attraction means associated with the monitor for attracting developer to the monitor and control means for controlling the attracting means for controlling the attracting means to cause developer to accumulate on the monitor from time to time.

The present invention further provides a toner developer concentration sensor assembly for an electrographic printing/copying apparatus comprising a toner monitor for measuring change in the permeability of said toner developer and providing a signal when said permeability reaches a predetermined value. There is a coil surrounding the toner monitor so that when energized toner is attracted to said toner monitor and control means are provided for alternatingly energizing said coil at a predetermined times for a predetermined time periods. A toner dispensing unit for dispensing new toner in response to the signal from the toner monitor.

The present invention further provides a method of automatically maintaining a developer mix comprising toner particles in a weight milo using a toner developer concentration monitor to maintain an optimum performing developer mix in a supply chamber by measuring changes in inductance for developing high quality electrostatic images comprising the steps of attracting the developer to the toner developer concentration monitor. While controlling the attracting step by alternatingly allowing the developer to accumulate on the toner developer concentration monitor during attraction for a predetermined time and a predetermined period and allowing the developer to fall away from the monitor when said predetermined period has expired and replenish toner powder from a toner dispensing unit into a supply chamber and re-mix the same with the developer mix when the inductance sensed by the toner developer concentration sensor increases above a predetermined level.

BRIEF DESCRIPTION OF THE DRAWINGS

In the detailed description of the preferred embodiments of the invention presented below, reference is made to the accompanying drawings in which.

DETAILED DESCRIPTION OF THE INVENTION

Figure 1:
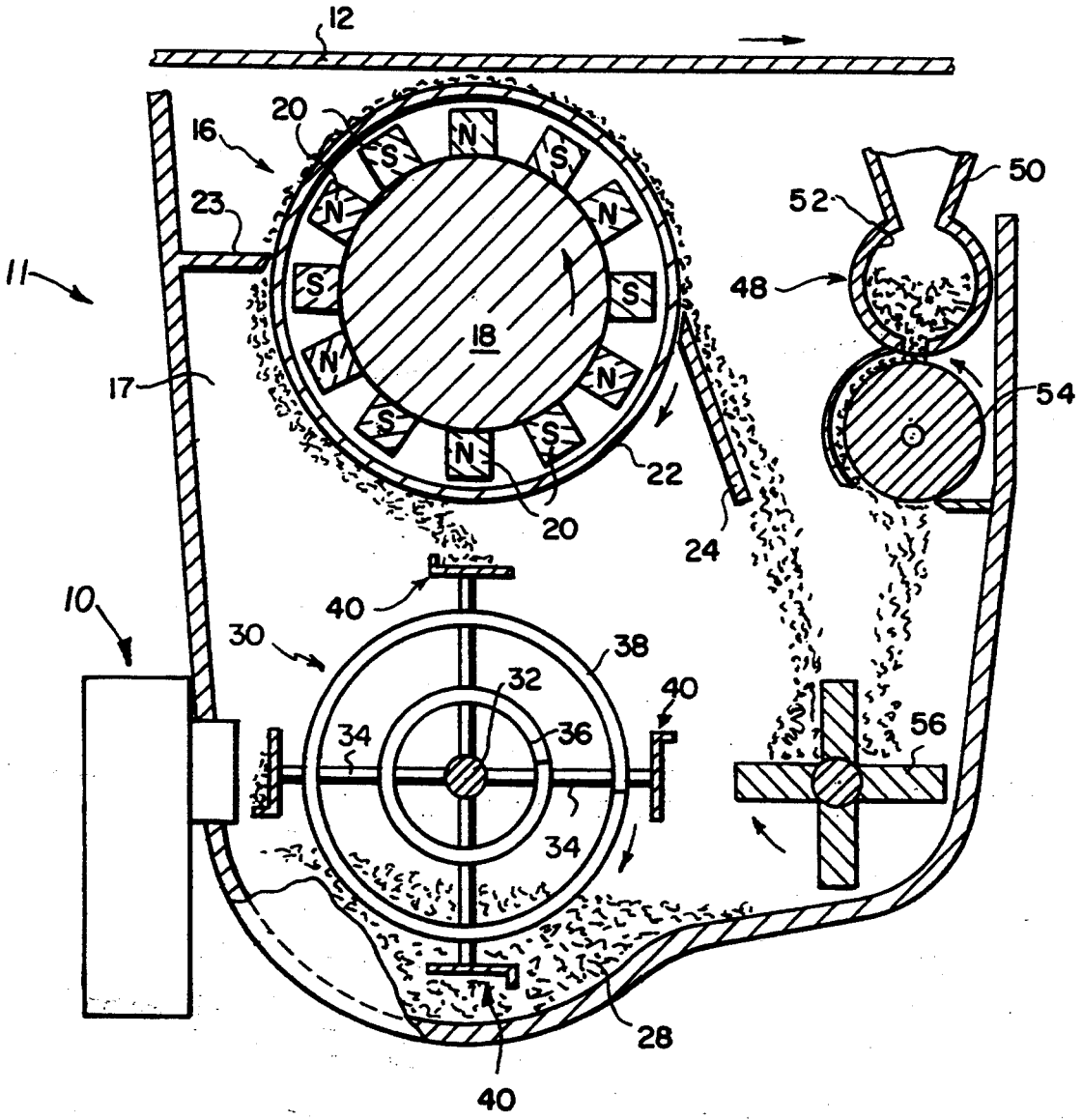
FIG. 1 is an end view of one preferred embodiment of the toner monitor of the present invention illustrated relative to the development apparatus on the insulated surface of a photoconductor or the like that is adapted to transport an electrostatic image thereon past the development apparatus.

Referring now to FIG. 1 of the drawings, a development apparatus 11 incorporating the toner monitor 10 of the present invention is adapted to provide a supply of marking particles, such as toner to an electrostatic image formed on the photoconductor 12 of electrophotographic apparatus to develop the image. The photoconductor can be in the form of an endless web, or drum, or discrete sheets. As known in the art, the photoconductor is moved along a path leading past the development apparatus 11 during operation of electrophotographic apparatus. The image developed on the photoconductor can be fused to the photoconductor or can be transferred to a receiver sheet and fused on such sheet as is well known in the electrographic arts.

Figure 2:
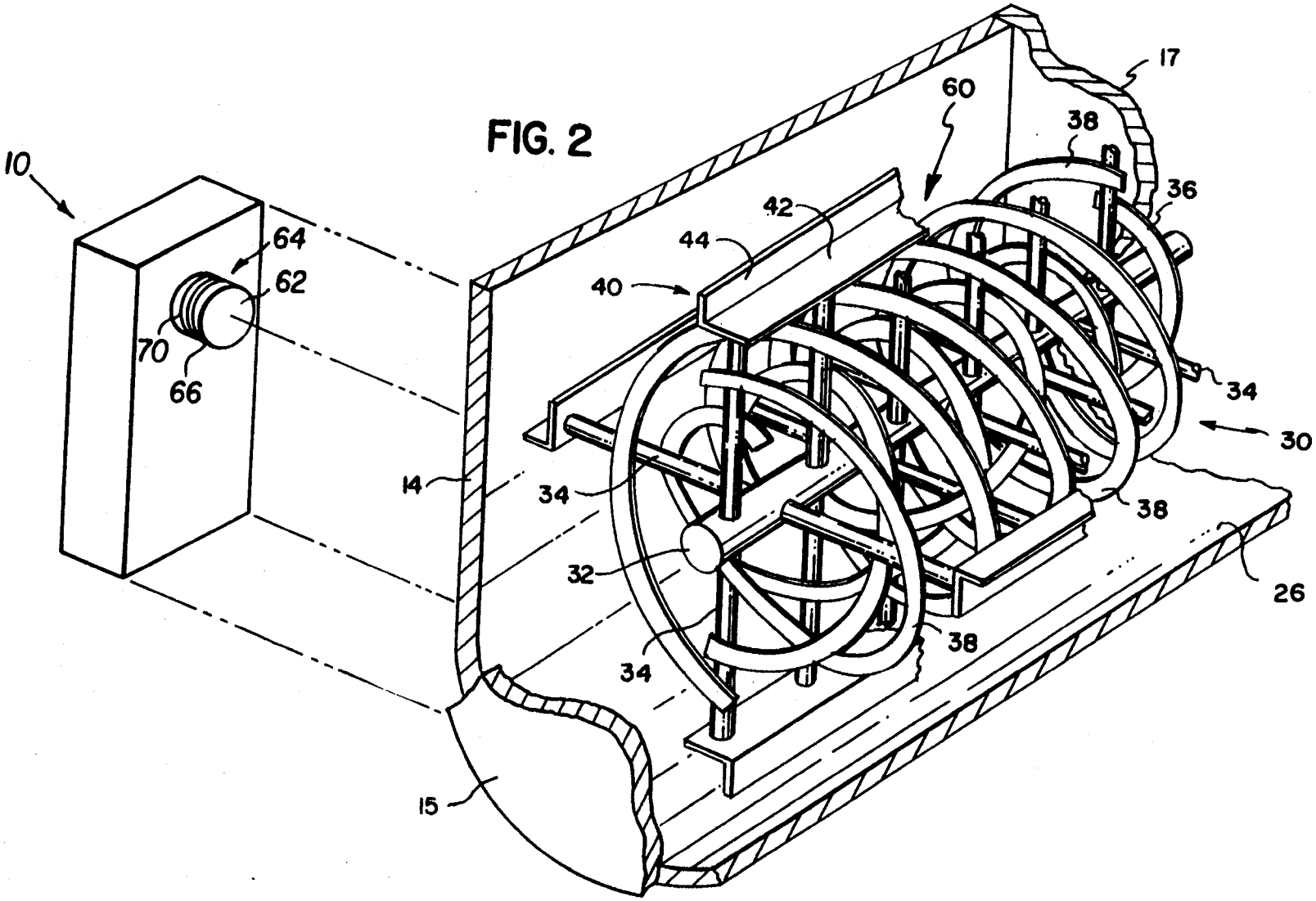
FIG. 2 is a fragmentary perspective view illustrating the toner monitor with respect to the paddle mixer and feeder vein assembly of the FIG. 1 apparatus.

The development apparatus 11 as seen in FIG. 2 has an elongated housing 14 with end walls 15 and 17. A magnetic brush 16 (FIG. 1) located in the upper portion of the housing 14 extends substantially the entire length of the housing and is closely adjacent to the path of the photoconductor 12. The magnetic brush preferably comprises a core 18 and a series of permanent magnets 20 concentrically arranged around the core 18. The core and magnets are rotatable in a counter-clockwise direction as viewed in FIG. 1 by a motor (not shown). Magnets 20 are arranged so that the poles of the outermost portions thereof are alternately north and south poles, as indicated in the drawings. Concentric with the core 18 and the magnets 20 is a cylindrical, non-magnetic shell 22 which is driven in a clockwise direction by suitable means (not shown). During rotation of the shell, the magnets 20 serve to hold magnetic developer material against the shell and thus bring such material into contact with the lower or insulating surface of the photoconductor 12 in a conventional manner.

A feed skive 23 has an edge adjacent to the surface of the shell 22. Skive 23 limits the thickness of the developer material 28 carded to the photoconductor 12 by the brush 16. Excess material 28 removed by skive 23 drops into sump 26. A wiper 24 removes material 28 from shell 22 after such material has been carried past the area of contact with the photoconductor 12.

The lower portion of the housing 14 beneath magnetic brush 16 is recessed to form a sump 26. The sump is adapted to receive a supply of developer material 28. The developer material may comprise a mixture of magnetic carrier particles and toner particles, the developer material may comprise a single component developer. The invention is particularly useful with a developer material comprising hard carrier particles of permanent magnet material and toner particles as disclosed in the U.S. Pat. No. 4,546,060.

Means are provided in sump 26 for mixing the developer material 28 and for feeding such material from sump 26 to magnetic brush 16. As disclosed in FIGS. 1 and 2, the mixing and feeding means comprises a combination ribbon blender and feeder vane assembly generally designated 30. Assembly 30 comprises a shaft 32 which is adapted to be driven in a clockwise direction as viewed by the drawing by a motor (not shown). Shaft 32 can be driven independently, or it can be coupled to the drive for brush 16 or other parts of the apparatus. A plurality of rods 34 project radiantly outward from the shaft 32. As shown in FIG. 2, the rods are arranged in pairs, with each rod of a pair being approximately 180° from the other rod of the pair and one particular pair of rods being offset 90° from the adjacent pair of rods. Also, adjacent pairs of rods are spaced axially on the shaft 32.

During rotation of the shaft 32, the ribbons 36 and 38 are effective to thoroughly mix the toner and carrier particles that make up the developer material as well as to circulate the developer material axially along the housing of the development apparatus both in a left-to-right direction and to a right-to-left direction. This movement of the developer material agitates and shears the developer material to promote tribo-charging thereof.

As toner from the developer material is transferred from the magnetic brush to the photoconductor 12, it becomes necessary to replenish the toner supply in the developer material. For this purpose, a toner replenishment mechanism generally designated 48 is provided. Mechanism 48 can be of any suitable construction, but preferably is one which allows for substantially uniform toner replenishment along the entire length of the sump of the development apparatus. By way of example, the toner replenishing mechanism may be constructed in a manner that comprises a supply hopper 50 through which a toner is supplied to a tube 52. A series of openings in the bottom of the tube allow toner to be dispensed throughout the length of the tube. The tube is substantially the same length as sump 26. A toner transport 54 can be located immediately beneath tube 52 and driven in the direction to dispense toner to the fight side of the housing 14 illustrated in FIG. 1. Transport 54 may be a so-called "paint roller" type of toner transport.

As fresh toner is delivered into the housing 14 from mechanism 48, it drops along a line or band extending the length of development apparatus and generally into a paddlewheel-type conveyor generally designated 56. The paddlewheel conveyor about an axis in a clockwise direction as indicated by the arrow. In addition, developer material which has been depleted of toner is stripped from shell 22 by the wiper 24 and is also delivered into the lower right portion of the housing generally in the area of the paddlewheel 56. This developer material depleted of toner and fresh toner arrive in the same general area of the housing and they are simultaneously delivered by the paddlewheel 56 into the lower portion of the sump 26 for mixture with other developer material in the sump by the ribbon blender and vane assembly 30.

In operation, magnetic brush 16 and shaft 32 are driven in the directions indicated by the arrows in FIG. 1. Developer material in sump 26 is mixed, circulated axially within the development apparatus and thus, triboelectrically charged by the ribbons 36 and 38, which constantly move the developer material in two opposite axial directions within the sump 26. This thorough mixing and moving of the developer material agitates and shears the developer to promote the required tribo-charging of the developer material. If desired, shaft 32 can be independently driven before rotation of the brush 16 is started in order to prepare the developer material for use.

Rotation of shaft 32 brings the feeder vanes 40 sequentially through the sump to pick up developer material and feed it to the position shown for the upper vane 40 in FIG. 1 at which point, developer material is attracted to the rotating shell 22 of the magnetic brush 16. Movement of the shell and the magnets 20 of the brush transports the developer material around the shell in a clockwise direction. As the material reaches the feed skive 23, excess developer material is removed from the brush and returned to the sump 26. Thus, a uniform thickness of developer material remains on the brush and is transported into contact with the lower insulating surface of the photoconductor 12 for transfer of toner material to an electrostatic image thereon. In FIG. 1, the photoconductor is shown moving co-current relative to shell 22, which could also be moved counter-current if desired.

As the magnetic brush continues to rotate, the toner depleted portion of developer material remaining on the brush reaches the wiper 24 and is removed from the brush. The removed developer material drops into the area of the paddlewheel 56 along with fresh toner from the mechanism 48. The paddlewheel 56 returns such material to the sump 26 for thorough mixing with the developer material remaining in the sump.

In the developer station sump 26 material is mixed back and forth to agitate and shear the developer and promote tribo-charging of the developer material. The blender 60 also pushes material past the head 62 of a toner monitor 64 so that the magnetic permeability, and this the toner concentration, of the mix can be measured. Around the head 62 of the toner monitor 64 is placed a magnetizing coil 70 with the ends of the coil being connected to a control circuit that is capable of supplying a source of DC power to energize the coil. This toner monitor 64 is formed of a flat wound coil packaged in a plate-like shape by resin mold 66. The coil is connected to a control circuit 68.

The use of a DC magnetic coil around a toner monitor which measures the magnetic permeability of the developer mix has the advantage that it is no longer restrained by the sump configuration. The control of the electromagnet is effected by the control unit such that the electromagnet is energized at predetermined intervals and for predetermined time intervals to attract the developer mix to the toner monitor. It is during this time interval that the toner monitor would be activated and measures the permeability of the toner developer. The predetermined interval that the electromagnet is energized does not have to be periodic and could be performed at random time intervals. The time interval that the toner monitor is activated need only be long enough to obtain an accurate reading and that both the electromagnet and monitor be activated frequently enough to detect changes in the concentration of the developer mix in time that it may be replenished so as to prevent the deterioration of the image being formed. Thus, the time interval the toner monitor is activated may be random and of a variable time interval within the constraints provided. The use of a periodic time interval for activation of both the electromagnet and the toner monitor may be more convenient to control. The control unit may comprise an electronic switching circuit, the details of which are readily selectable from conventional electronics.

For example, a suitable circuit for control circuit 68 may comprise an oscillator whose output is connected through a coupling capacitor to the toner monitor coil, the capacitor and the coil being coupled substantially in series or resonance condition. Alternatively, the control unit may include a microprocessor and appropriate software for effecting the functions described above.

A DC magnet coil around a toner monitor which measures the magnetic permeability of the developer mix is activated at prescribed intervals to align the mix in a consistent fashion over the detecting zone. The DC magnetic coil produces a magnetic field between 100 to 1000 gauss. The permeability of the mix is measured, the current to the coil in inhibited which allows the measured samples to be moved out by the paddles. Current to the coil is again activated, another sample is captured and aligned. The maximum sampling frequency would be dependent on developer flow. Too high a sampling frequency may recapture and measure the same developer sample. Too low a sampling frequency would not be representative of the developer mix and improper replenishment would occur.

Figure 3:
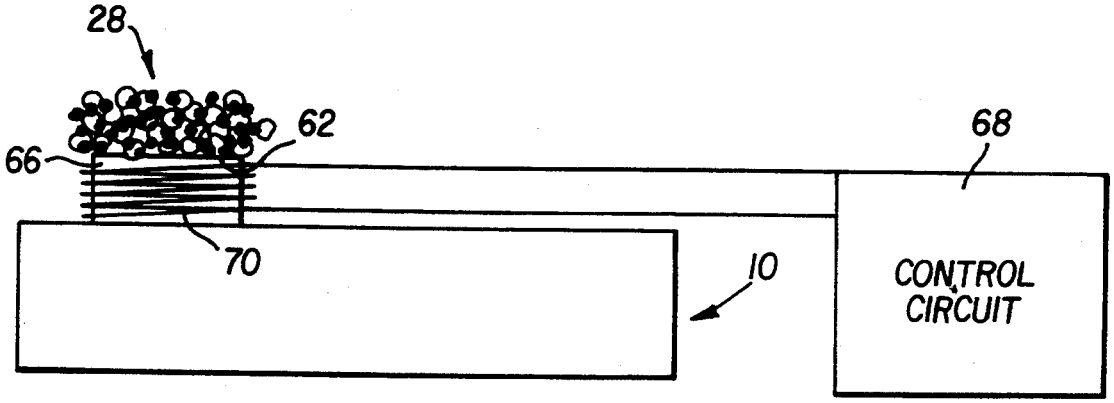
FIG. 3 illustrates an enlarged view of the toner monitor according to the present invention without the coil being activated.

In small particle development (SPD), the carrier particles are permanently magnetized. These magnetized particles have a tendency of being attracted to one another which is known as "flax closure" and especially occurs when the toner concentration is decreased (shown in FIG. 3). The carries are no longer spaced from one another and they are magnetically attracted to each other forming a more sloth state with less magnetic permeability. Being less permeable, the monitor interprets this state as a high toner concentration. Therefore, the process control inhibits lower replenishment and the effective toner concentration in the developer mix decreases.

Figure 4:
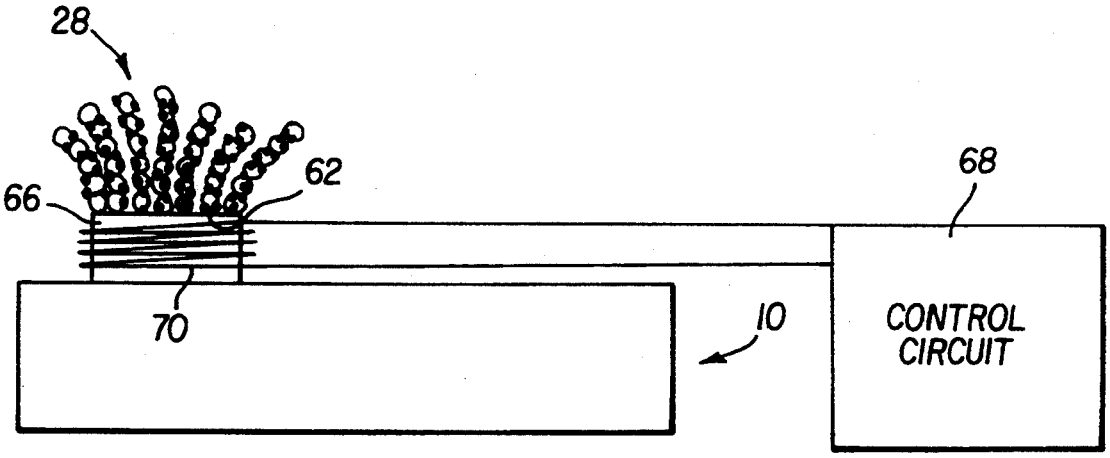
FIG. 4 illustrates an enlarged view of the toner monitor shown in FIG. 3 with the coil activated.

Using the coil around the monitor, the produced magnetic field would align the carrier in the flux closure state (FIG. 4). The correct permeability of the mix would then be measured and the proper toner concentration of the mix would be attained.

In small particle development (SPD), the carrier particles are permanently being attracted to one another in what is termed "flux closure"; this tends to occur when toner concentration is decreased. The carriers are no longer spaced from one another and they are magnetically attracted to each other forming a more stable state with less magnetic permeability. Being less permeable, the monitor interprets this state as a high toner concentration. Therefore, the process control inhibits toner replenishment and the effective toner concentration in the developer mix decreases.

Use of the present invention obviates such a problem because the use of a coil around the toner monitor produces a magnetic field when the coil is energized that would align the carrier in the flux closure state as shown in FIG. 4. The correct permeability of the mix would then be measured and the proper toner concentration of the mix would be attained.

The invention has been described in detail with particular reference to preferred embodiments thereof, but it will be understood that variations and modifications can be effected within the spirit and scope of the invention as described hereinabove and as defined in the appended claims.

We claim:

1. An electrostatographic machine comprising:

a supply sump for mixing and supplying toner developer to said machine during operation;

a toner monitor mounted adjacent to said supply sump for measuring the magnetic permeability of the toner developer in said sump;

a coil wound about said toner monitor forming an electromagnet for attracting developer to said monitor; and control means for controlling current in said coil to cause developer to accumulate on the monitor from time to time.

2. An electrostatographic machine as set forth in claim 1 wherein said toner monitor is the core of the electromagnet.

3. An electrostatographic machine as set forth in claim 2 wherein the electromagnet produces a magnetic field between 100 and 1000 gauss.

4. A toner developer concentration sensor assembly for an electrographic printing/copying apparatus comprising:

a toner monitor for measuring the change in the permeability of said toner developer;

a coil surrounding said toner monitor so that when energized toner is attracted to said toner monitor; and control means for energizing said coil at predetermined times for predetermined time periods.

5. A toner developer concentration sensor assembly for an electrographic printing/copying apparatus comprising:

a toner monitor for measuring the change in the permeability of said toner developer and providing a signal when said permeability reaches a predetermined value;

a coil surrounding said toner monitor so that when energized toner is attracted to said toner monitor;

control means for energizing said coil, at predetermined times for predetermined time periods; and toner dispensing unit for dispensing new toner in response to said signal from said toner monitor.

6. A method of automatically monitoring a developer mix comprising toner particles in a weight ratio using a toner developer concentration sensor to adjust a process control parameter such as the voltage on a corona charger to increase the voltage on a photoconductor to maintain optimum performance as the developer mix changes in a supply chamber, changes in inductance, while developing high quality electrostatic images comprising:

attracting the developer to the toner developer concentration sensor;

controlling the attracting step by alternatingly allowing the developer to accumulate on the toner developer concentration sensor during attraction for a predetermined time and a predetermined time interval and allowing the developer to fall away from the sensor when said predetermined period has expired; and adjusting the voltage on the corona charger to increase the voltage on the photoconductor to increase the transfer of toner particles to the image formed thereon when the inductance sensed by the toner developer concentration sensor increases above a predetermined level.

* * * * *